US005714848A

United States Patent [19]

Hilbig et al.

[11] Patent Number: 5,714,848

[45] Date of Patent: Feb. 3, 1998

[54] VARIABLE COLOR DISCHARGE LAMP

[75] Inventors: Rainer Hilbig; Uwe Chittka; Pieter Postma, all of Aachen, Germany

[73] Assignee: U.S. Philips Corporation, New York, N.Y.

[21] Appl. No.: 566,778

[22] Filed: Dec. 4, 1995

[30] Foreign Application Priority Data

Dec. 5, 1994 [EP] European Pat. Off. ..... 94203533

[51] Int. Cl.[6] ..... H05B 37/00

[52] U.S. Cl. ..... 315/334; 315/94; 315/DIG. 1

[58] Field of Search ..... 315/336, 334, 315/335, 326, 94, 101, 105, 106, 107, 74, DIG. 1

[56] References Cited

U.S. PATENT DOCUMENTS

| | | | |
|---|---|---|---|
| 3,634,718 | 1/1972 | Larson | 313/198 |
| 4,029,989 | 6/1977 | Fellows | 315/51 |
| 4,625,152 | 11/1986 | Nakai | 315/317 |
| 5,233,272 | 8/1993 | Whang et al. | 315/168 |
| 5,336,974 | 8/1994 | Luijks et al. | 315/58 |

FOREIGN PATENT DOCUMENTS 2-276150 1/1991 Japan .

*Primary Examiner*—Robert Pascal
*Assistant Examiner*—David Vu
*Attorney, Agent, or Firm*—Edward Blocker

[57] ABSTRACT

A circuit arrangement for alternatingly, at a frequency f, establishing and extinguishing a discharge in each of a plurality of discharge paths, each of which is associated with a first electrode situated at a first end of the discharge path and with a second electrode situated at a second end of the discharge path. Operating voltages are generated from a supply voltage during operation and are present across respective discharge paths and are periodic at the frequency f. The same operating voltage is present across each discharge path. During operation each discharge path is associated with an auxiliary electrode situated alongside the discharge path and the circuit arrangement further comprises respective switching devices for connecting and disconnecting each of the auxiliary electrodes at the frequency f to a terminal of the circuit arrangement to establish an ignition voltage during a part of each period between one of the electrodes and the auxiliary electrode associated with the same discharge path. As a result, a discharge is only established in the proper discharge path(s).

20 Claims, 5 Drawing Sheets

VARIABLE COLOR DISCHARGE LAMP

The invention relates to a circuit arrangement for alternatingly, at a frequency f, establishing and extinguishing of a discharge in each of a plurality of discharge paths, each of which is associated with a first electrode situated at a first end of the discharge path and with a second electrode situated at a second end of the discharge path, comprising means for generating operating voltages from a supply voltage, said operating voltages during operation being present over respective discharge paths and being periodical with the frequency f.

The invention also relates to a lighting arrangement comprising a plurality of discharge paths.

A circuit arrangement as mentioned in the opening paragraph is known from Japanese patent application JP-A-03 222290. The known circuit arrangement is used in combination with two fluorescent lamps. These fluorescent lamps each provide a discharge path and the associated electrodes. The fluorescent lamps are equipped with different luminescent layers. Each of the fluorescent lamps is connected in series with a bipolar transistor to the terminals of a DC voltage source. During lamp operation each of the bipolar transistors is alternatingly rendered conductive and non-conductive at a frequency f by means of signals generated by a signal generator that, together with the bipolar transistors, forms a part of the means for generating operating voltages from a supply voltage. When one of the bipolar transistors is conducting, the other one is non-conducting. The sum of the duty cycles of both bipolar transistors is 1. By adjusting the duty cycle of one of the bipolar transistors (and thereby correspondingly adjusting the duty cycle of the other transistor) the fractions of time during which the DC voltage is present across each of the lamps can be adjusted. The fraction of time during which the DC voltage is present over one of the lamps determines the shape of the operating voltage over that lamp which, in turn, influences the light output of that lamp so that by adjusting the duty cycle of one of the transistors the color of the light that the two lamps radiate together is adjusted. If the frequency f is high enough the light radiated by the lamps is percepted by the human eye as light of a constant colour. During each period associated with frequency f the following sequence is taking place: during a first time interval of the period the transistor in series with one of the lamps is non-conductive while the transistor in series with the other lamp is conductive. The lamp in series with the conductive transistor ignites under the influence of the DC voltage and the installed discharge causes this lamp to radiate light of a first color point. At the end of the first time interval the conductive transistor becomes non-conductive so that the discharge in the lamp in series with this transistor extinguishes. This transistor remains non-conductive during a second time interval that constitutes the remaining part of the period. The transistor that was non-conductive during the first time interval becomes conductive in the second time interval so that the lamp in series with it ignites under the influence of the DC voltage and the installed discharge causes the lamp to radiate light of a second colour point. Since the operating voltages of the two lamps differ in the known circuit arrangement a transistor is needed in series with each of the lamps. As a result the known circuit arrangement is relatively complicated and expensive.

SUMMARY OF THE INVENTION

The invention aims to provide a circuit arrangement that is relatively simple and cheap.

A circuit arrangement as described in the opening paragraph is therefore characterized, according to the invention in that the same operating voltage is present across each discharge path, in that during operation each discharge path is associated with an auxiliary electrode situated alongside the discharge path, and in that the circuit arrangement further comprises switching means for connecting and disconnecting each of the auxiliary electrodes at a frequency f to a terminal of the circuit arrangement to establish an ignition voltage during a part of each period between one of the electrodes and the auxiliary electrode associated with the same discharge path.

The electrodes can be incorporated in lamps suitable to be operated by means of a circuit arrangement according to the invention. The electrodes can also be part of the circuit arrangement. The electrodes can be present in the discharge during operation, but it is also possible for the electrodes to be capacitively coupled to the discharge. The auxiliary electrode can be part of a lamp operated by means of the circuit arrangement, but can also be a part of the circuit arrangement. Each discharge path can be incorporated in a separate lamp vessel, but it is also possible to incorporate two or more discharge paths in one lamp vessel.

During part of its period, the operating voltage present across the discharge paths and between each pair of electrodes has a value high enough to maintain a discharge present in one or more of the discharge paths but not high enough to establish a discharge (ignite the discharge path). During a second part of its period the operating voltage attains a value at which any discharge present in one of the discharge paths extinguishes. When, during a third part of its period, the operating voltage once more attains a value high enough to maintain a discharge, the switching means connect one or more of the auxiliary electrodes to the terminal of the circuit arrangement. The ignition voltage present between such a connected auxiliary electrode and one of the electrodes associated with the same discharge path causes ignition and the subsequent establishment of a discharge in this discharge path. The switching means together with the auxiliary electrodes thus form a simple means for selecting the discharge path(s) in which a discharge is present during a time interval in which the amplitude of the operating voltage has a value that is high enough to maintain a discharge. Since, in a circuit arrangement according to the invention, the same operating voltage is applied to every discharge path, the circuit arrangement is relatively simple and therefore relatively cheap. In addition to that advantage, during the establishing and extinguishing of discharges in the discharge paths using a circuit arrangement according to the invention, only a relatively small amount of power is dissipated.

In a relatively simple construction of a circuit arrangement according to the invention, the terminal is at the same potential as one of the electrodes of each discharge path during operation. Since the switching means connect the auxiliary electrode(s) to this terminal, the ignition voltage present between the other electrode associated with the same discharge path and the auxiliary electrode equals the operating voltage.

A DC voltage can be used as an operating voltage. Depending on the plasma comprised in the discharge path (s), however, it can be desirable to use an alternating voltage as the operating voltage. Such an alternating voltage can be a low frequency alternating voltage such as the mains supply voltage at a frequency of 50 or 60 Hz. The alternating voltage can also be a high frequency alternating voltage. It is well known for instance that low pressure mercury lamps can be operated with a high efficacy by means of a high frequency alternating voltage as the operating voltage.

Since each discharge path is not maintaining a discharge during a part of each period of the operating voltage, it is often advantageous if the circuit arrangement is equipped with means for supplying a heating current to the electrodes. In this way it can be prevented that the temperature of the electrodes decreases to a value at which their life time is only very short.

It has been found that a very effective operation resulted where the amplitude of the operating voltage is substantially square wave modulated. Both the extinguishing as well as the ignition of the discharges take place immediately after the square wave changes from high to low or from low to high respectively. Also, the color of the light radiated by the discharge paths can be easily adjusted where the time intervals during which the amplitude of the substantially square wave modulation is high are adjustable.

BRIEF DESCRIPTION OF THE DRAWING

Embodiments of the invention will be illustrated further making use of the accompanying drawing. In the drawing.

DESCRIPTION OF THE PREFERRED EMBODIMENTS

Figure 1:
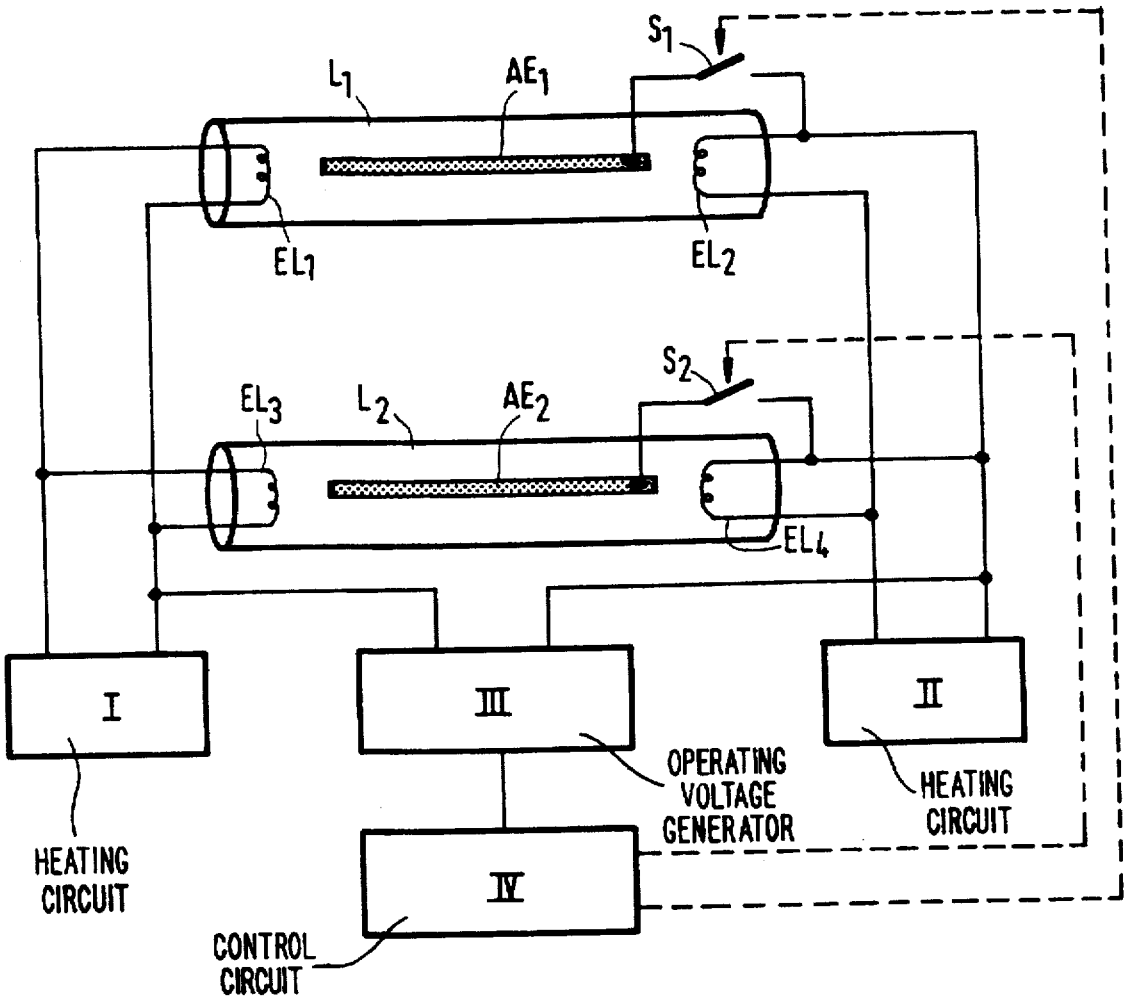
FIG. 1 is a schematic representation of an embodiment of a lighting arrangement according to the invention comprising a circuit arrangement according to the invention.

In FIG. 1, L1 and L2 are discharge lamps. The discharge lamps incorporate different luminescent layers. Discharge lamp L1 is equipped with electrodes E11 and El2 and discharge lamp L2 is equipped with electrodes E13 and E14. A discharge path exists in each discharge lamp between its electrodes. Discharge lamp L1 is also equipped with an auxiliary electrode AE1 consisting of a strip of electrically conductive material attached to the outside of the lamp vessel of discharge lamp L1. Similarly discharge lamp L2 is equipped with an auxiliary electrode AE2. A switching element S1 connects auxiliary electrode AE1 to electrode E12. A further switching element S2 connects auxiliary electrode AE2 to electrode E14. Circuit parts I and II each constitute means for heating the electrodes. For this purpose output terminals of circuit part I are coupled to electrodes E11 and E13 while output terminals of circuit part II are coupled to electrodes E12 and E14. Circuit part III constitutes means for generating an operating voltage from a supply voltage. The coupling between circuit part III and a supply voltage source is not shown in FIG. 1. A first output terminal of circuit part III is connected to electrodes E11 and E13. A second output terminal of circuit part III is connected to electrodes E12 and E14. During operation the operating voltage is present between the first and the second output terminal and therefore also between electrodes E11 and E12 and between electrodes E13 and E14. Circuit part III further comprises ballast means (not shown in FIG. 1) such as an inductance to limit the current through discharge lamps L1 and L2. Circuit part IV coupled to circuit part III constitutes a control circuit for generating control signals for rendering switching element S1 and switching element S2 conducting and non-conducting. Output terminals of circuit part IV are therefore coupled to control electrodes of the switching elements S1 and S2. In FIG. 1 this coupling is indicated by means of a dotted line. Circuit part IV together with the switching elements S1 and S2 form in this embodiment the switching means for connecting and disconnecting each of the auxiliary electrodes at frequency f to a terminal of the circuit arrangement to establish an ignition voltage, during a part of each period, between one of the electrodes and the auxiliary electrode associated with the same discharge path. In this embodiment the terminal is the second output terminal of circuit part III. As a result the ignition voltage that is present between the auxiliary electrode and one of the electrodes of the discharge lamp, when its associated switching element is conducting, equals the operating voltage.

Figure 4:
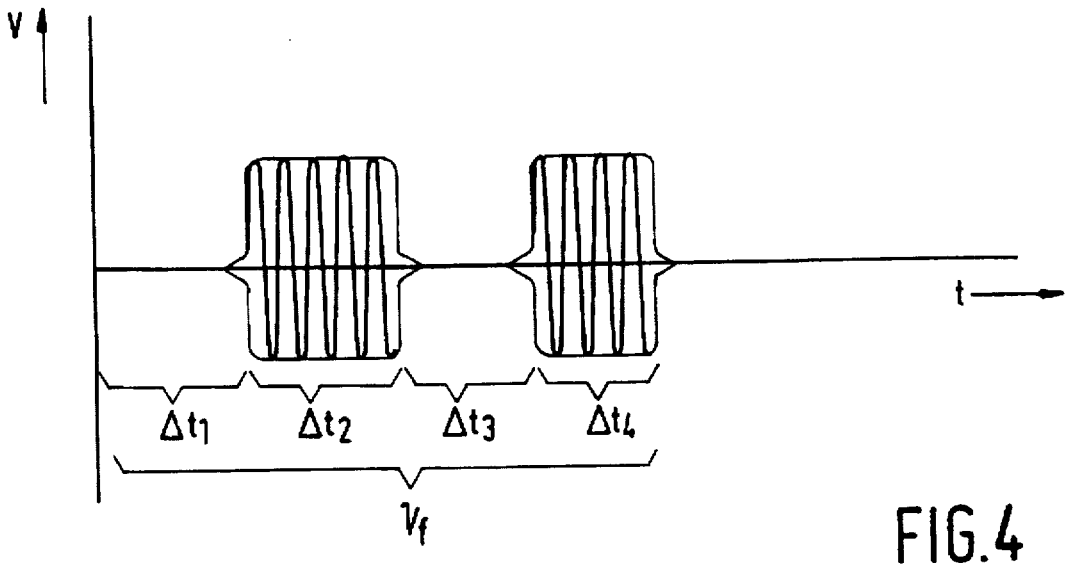
FIG. 4 shows the shape of the operating voltage present across discharge lamps incorporated in the lighting arrangement shown in FIG. 1.

The lighting arrangement shown in FIG. 1 operates as follows. During operation circuit part III generates an operating voltage shaped as illustrated in FIG. 4. In FIG. 4 voltage is plotted in arbitrary units along the vertical axis. Along the horizontal axis time is plotted in arbitrary units. FIG. 4 shows one period of the operating voltage. As can be seen the operating voltage employed in the embodiment shown in FIG. 1 is a substantially square wave modulated high frequency voltage. Each period of the operating voltage consists of four consecutive time intervals: $\Delta t1$, $\Delta t2$, $\Delta t3$ and $\Delta t4$. These time intervals are indicated in FIG. 4. During the first time interval $\Delta t1$ the amplitude of the operating voltage is substantially zero and consequently neither of the two discharge lamps carries a current. During the first time interval circuit part IV renders switching element S1 conductive and switching element S2 non-conductive. In the second time interval $\Delta t2$ the operating voltage is a high frequency AC voltage. This high frequency voltage is present between electrodes E11 and E12, between electrodes E13 and E14 and also between auxiliary electrode AE1 and electrode E11. The amplitude of the high frequency voltage is insufficient to establish a discharge in discharge lamp L2. The distance between auxiliary electrode AE1 and electrode E11 is relatively small so that a relatively strong electric field exist in the plasma of discharge lamp L1. As a result of this relatively strong electric field, discharge lamp L1 ignites and a discharge is established between electrodes E11 and E12. This discharge is maintained during the second time interval. Accordingly, during the second time interval the lighting arrangement radiates light of a color associated with the composition of the luminescent layer in discharge lamp L1. At the beginning of the third time interval $\Delta t3$ the discharge in discharge lamp L1 extinguishes since the amplitude of the operating voltage is substantially zero. During the third time interval circuit part IV renders the switching element S2 conductive and switching element S1 non-conductive. During the fourth time interval the operating voltage is again a high frequency voltage at an amplitude substantially equal to the amplitude of the operating voltage during the second time interval. During the fourth time interval the operating voltage is also present between auxiliary electrode AE2 and electrode E13. As a result discharge lamp L2 ignites and a discharge is established between electrodes E13 and E14. This discharge is maintained during the fourth time interval. During the fourth time interval the discharge lamp L1 is not ignited so that during the fourth time interval the lighting arrangement radiates light of a color associated with the composition of the luminescent layer in discharge lamp L2. The color of the total amount of light radiated by the lighting arrangement depends on the duration of the second and fourth time intervals. Preferably these durations are adjustable so that the colour of the light can be adjusted.

It should be mentioned that the lighting arrangement shown in FIG. 1 could also be operated by, for instance, an operating voltage that is a substantially square wave modulated DC-voltage instead of a substantially square wave modulated high frequency voltage.

Figure 2:
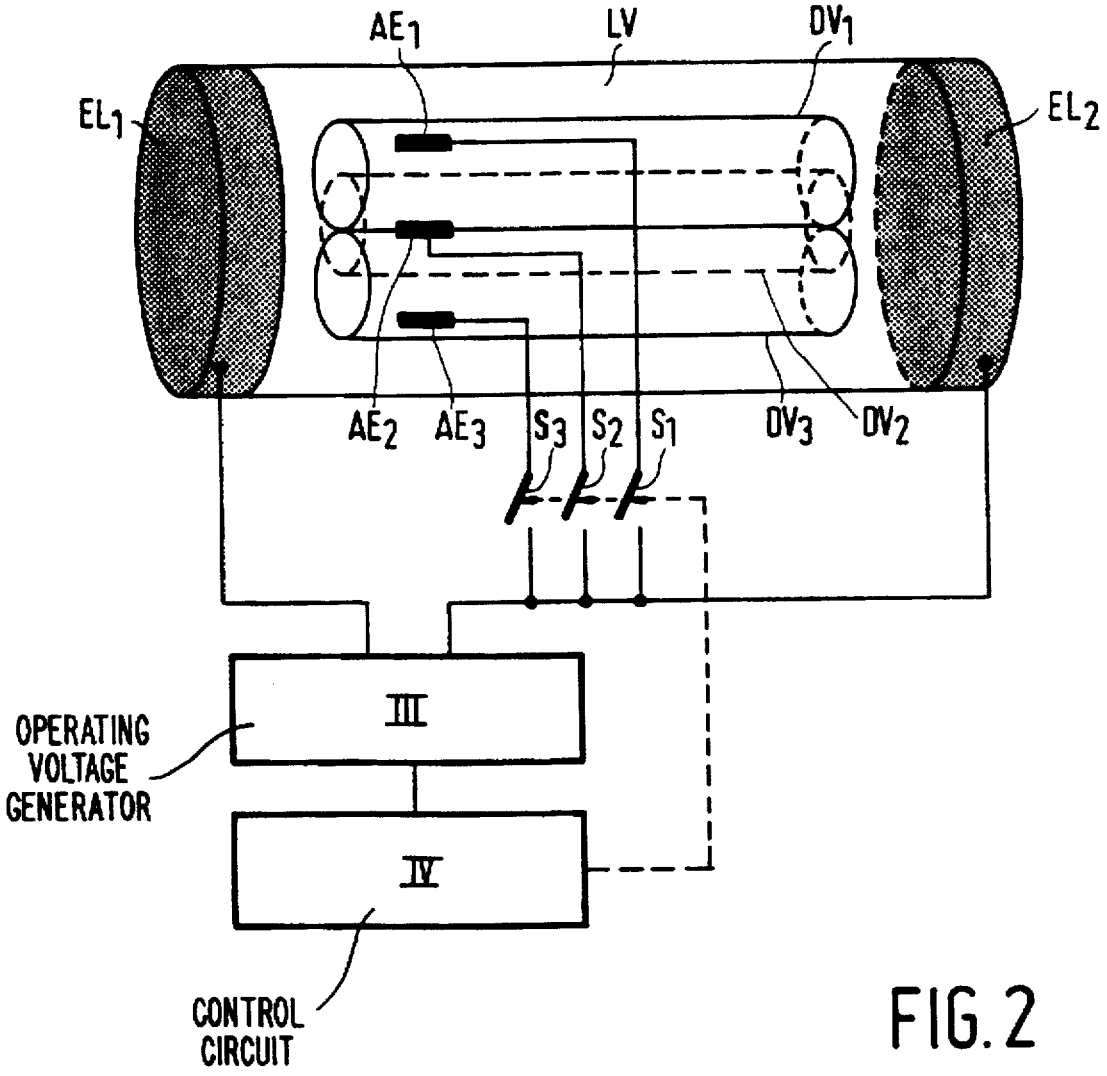
FIG. 2 shows a schematic representation of a further embodiment of a lighting arrangement according to the invention comprising a circuit arrangement according to the invention.

In FIG. 2 LV is a tube-shaped transparent lamp vessel. On each side this vessel is closed with a metal lid: E11 and E12. During operation of the lighting arrangement these metal lids function as electrodes. The lamp vessel is filled with a noble gas such as Ar and a small amount of mercury. Around the axis of the lamp vessel three tube-shaped discharge vessels are mounted: DV1, DV2 and DV3. Each of the discharge vessels is opened on both sides and is equipped with an auxiliary electrode consisting of a strip of electrically conductive material. The inside wall of each of the discharge vessels is covered with a luminescent layer. Each discharge vessel has a different luminescent layer. Preferably the luminescent layers are chosen so that during operation, in case there is a discharge established in the discharge vessel, the respective discharge vessels radiate blue, green and red light. In FIG. 2 the auxiliary electrodes are indicated as AE1, AE2 and AE3. By means of the switches S1, S2 and S3 these auxiliary electrodes are connected to a second output terminal of circuit part III. Circuit part III forms the means for generating an operating voltage from a supply voltage. During operation this operating voltage is present between a first output terminal and the second output terminal of circuit part III. The first output terminal is connected to electrode E11 and the second output terminal is connected to electrode E12. Circuit part III further comprises ballast means (not shown in FIG. 1) such as an inductance to limit the current through the discharge vessels. Circuit part IV coupled to circuit part III constitutes a control circuit for generating control signals for rendering switching elements S1, S2 and S3 conducting and non-conducting. Output terminals of circuit part IV are therefore coupled to control electrodes of the switching elements S1, S2 and S3. In FIG. 2 this coupling is indicated by means of a dotted line. Circuit part IV together with the switching elements S1, S2 and S3 form in this embodiment the switching means for connecting and disconnecting each of the auxiliary electrodes at a frequency f to a terminal of the circuit arrangement to establish an ignition voltage during a part of each period between one of the electrodes and the auxiliary electrode associated with the same discharge path. In this embodiment both electrode E11 as well as electrode E12 are associated with each of the three discharge paths defined by the three discharge vessels. Moreover the terminal is the second output terminal of circuit part III. As a result the ignition voltage that is present between the auxiliary electrode and electrode E11, when its associated switching element is conducting, equals the operating voltage.

Figure 5:
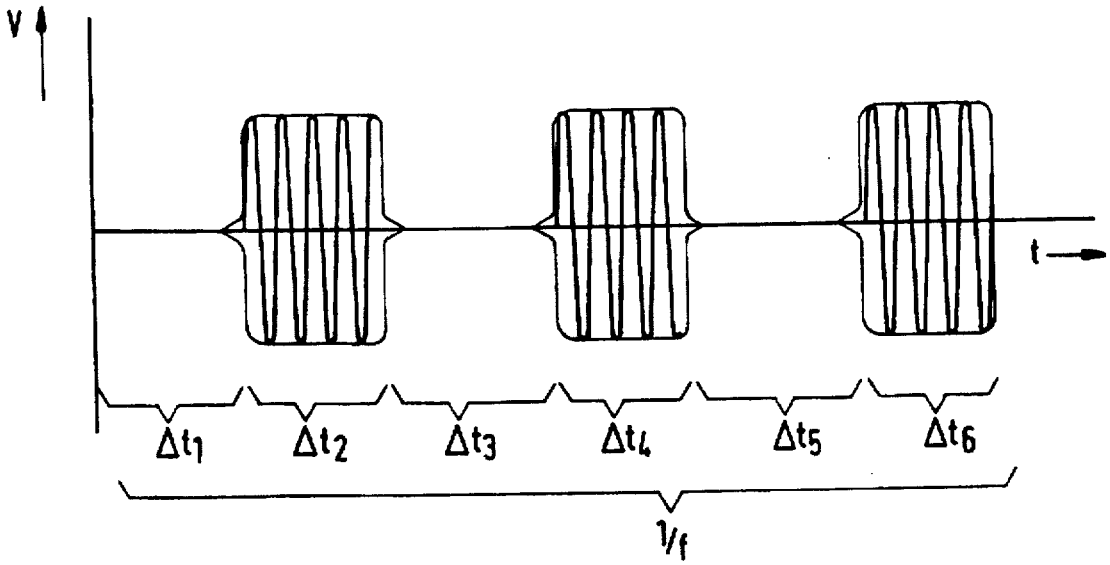
FIG. 5 shows the shape of the operating voltage present across discharge paths incorporated in the lighting arrangement shown in FIG. 2.

The lighting arrangement shown in FIG. 2 operates as follows. During operation circuit part III generates an operating voltage shaped as illustrated in FIG. 5. In FIG. 5 voltage is plotted in arbitrary units along the vertical axis. Along the horizontal axis time is plotted in arbitrary units. FIG. 5 shows one period of the operating voltage. As can be seen the operating voltage employed in the embodiment shown in FIG. 2 is a substantially square wave modulated high frequency voltage. Each period of the operating voltage consists of six consecutive time intervals: Δt1, Δt2, Δt3 Δt4, Δt5 and Δt6. These time intervals are indicated in FIG. 5. During time intervals Δt1, Δt3 and Δt5 switching elements S1, S2 and S3 are rendered conductive respectively and remain conductive during the next time interval. When one of the switching elements is rendered conductive, the other switching elements are rendered non-conductive. As a result a discharge is present in discharge vessel DV1 during time interval Δt2, in discharge vessel DV2 during time interval Δt4 and in discharge vessel DV3 during time interval Δt6. The duration of these time intervals determines the output of blue, green and red light in one period of the operating voltage and therefore the color of the light emitted by the lighting arrangement as experienced by the human eye. By adjusting the duration of these time intervals it is possible to adjust the colour of the light radiated by the lighting arrangement.

Figure 3A:
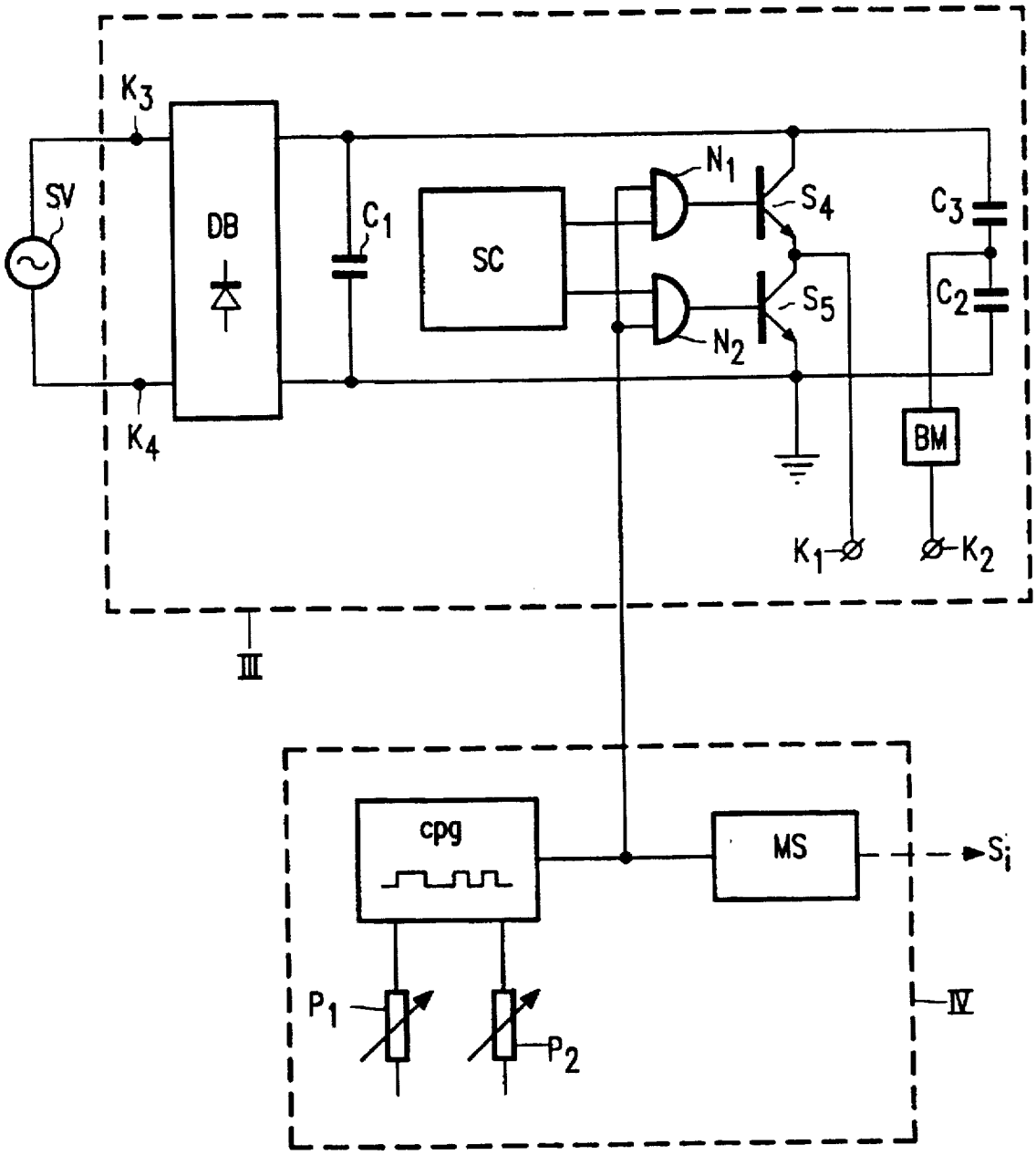
FIG. 3*a* shows a schematic representation of an embodiment of a part of the circuit arrangements comprised in the embodiments shown in FIG. 1 and FIG. 2.

In FIG. 3*a* circuit part III is formed by terminals K3 and K4, rectifier bridge DB, capacitors C1, C2 and C3, control circuit SC, and-gates N1 and N2, switching elements S4 and S5, ballast means BM and output terminals K1 and K2. Circuit part IV is formed by control pulse generator CPG, means P1 and means P2 and multiplexing switch MS. K3 and K4 are terminals for connection to a low frequency supply voltage SV. Terminals K3 and K4 are connected to respective input terminals of rectifier bridge DB. A first output terminal of rectifier bridge DB is connected to a second output terminal of rectifier bridge DB by means of capacitor C1, which functions as a buffer capacitor during operation. Capacitor C1 is shunted by a series arrangement of switching elements S4 and S5 and by a series arrangement of capacitor C2 and capacitor C3. A common terminal of switching element S4 and switching element S5 is connected to output terminal K1. A common terminal of capacitor C2 and capacitor C3 is connected to output terminal K2 by means of the ballast means BM. During operation the output terminals K1 and K2 are coupled to the electrodes associated with the discharge paths. A first output terminal of control circuit SC is connected with a first input terminal of and-gate N1. A second output terminal of control circuit SC is connected with a first input terminal of and-gate N2. An output terminal of and-gate N1 is connected to a control electrode of switching element S4. An output terminal of and-gate N2 is connected to a control electrode of switching element S5. A second input terminal of and-gate N1 and a second input terminal of and-gate N2 are connected to an output terminal of control pulse generator CPG. Input terminals of control pulse generator CPG are coupled to the means P1 and the means P2 respectively. The output terminal of control pulse generator CPG is connected to an input terminal of multiplexing switch MS. Output terminals of the multiplexing switch MS are coupled respectively to the switching elements S1 and S2 in an embodiment as shown in FIG. 1 and to the switching elements S1, S2 and S3 in an embodiment as shown in FIG. 2. This coupling is indicated in FIG. 3 by means of a dotted line.

The circuit parts III and IV in FIG. 3*a* operate as follows. During operation the low frequency supply voltage delivered by the low frequency supply voltage source SV is rectified by the rectifier bridge DB. As a result a DC voltage is present across capacitor C1. Control circuit SC during operation generates control signals for rendering the switching elements S4 and S5 alternately conductive and non-conductive. When the output terminal of control pulse generator CPG is high, these control signals are coupled via and-gates N1 and N2 to the control electrodes of switching elements S4 and S5 rendering the switching elements S4 and S5 alternately conductive and non-conductive. As a result a discharge current is generated that flows through the ballast means BM and the discharge paths where a discharge is established by means of the auxiliary electrodes. When the output terminal of control pulse generator CPG is low, the voltage at the control electrodes of switching elements S4 and S5 is also low so that both switching elements are non-conductive and no discharge current is generated. The control pulse generator CPG generates at its output terminal a periodical substantially square wave signal having the same frequency as the operating voltage. In the case of a lighting arrangement as shown in FIG. 1, each period of the substantially square wave signal comprises two rectangular pulses having a width equal to the duration of time intervals $\Delta t2$ and $\Delta t4$ respectively. In the case of a lighting arrangement as shown in FIG. 2, each period of the substantially square wave signal comprises three rectangular pulses having a width equal to the duration of time intervals $\Delta t2$, $\Delta t4$ and $\Delta t6$. Means P1 offers a user of the lighting arrangement the possibility to manually adjust the ratio of the widths of the rectangular pulses comprised in a period. Means P2 offers a user of the lighting arrangement the possibility to adjust the sum of the widths of the rectangular pulses comprised in a period. The means P1 and P2 may comprise variable resistors. In a lighting arrangement as shown in FIG. 1 the multiplexing switch renders switching element S1 conductive during the first rectangular pulse in each period and renders switching element S2 conductive during the second rectangular pulse in each period. In a lighting arrangement as shown in FIG. 2, switching elements S1, S2 and S3 are respectively rendered conductive by the multiplexing switch MS during the first, second and third rectangular pulse in each period.

Figure 3B:
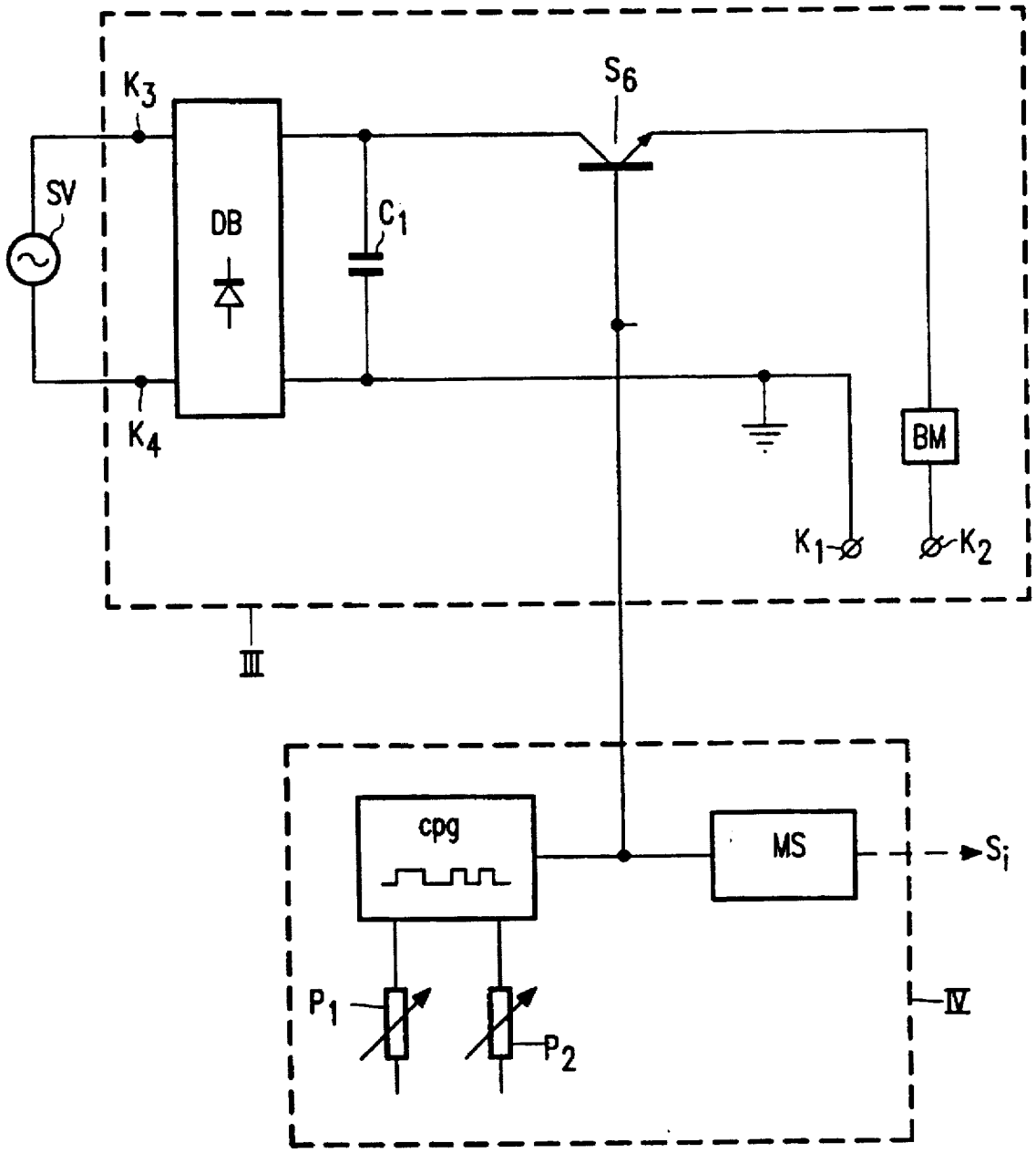
FIG. 3*b* shows a schematic representation of a further embodiment of a part of the circuit arrangements comprised in the embodiments shown in FIG. 1 and FIG. 2.

In FIG. 3*b* circuit part IV is identical to the circuit part IV shown in FIG. 3*a*. The circuit part III is formed by terminals K3 and K4, rectifier bridge DB, capacitor C1, switching element S6 and ballast means BM. K3 and K4 are terminals for connection to a low frequency supply voltage SV. Terminals K3 and K4 are connected to respective input terminals of rectifier bridge DB. A first output terminal of rectifier bridge DB is connected to a second output terminal of rectifier bridge DB by means of capacitor C1, which functions as a buffer capacitor during operation. A series arrangement of switching element S6 and ballast means BM connects the first output terminal of rectifier bridge DB with output terminal K2. The second output terminal of rectifier bridge DB is connected to output terminal K1. During operation the output terminals K1 and K2 are coupled to the electrodes associated with the discharge paths. A control electrode of switching element S6 is connected to an output terminal of control pulse generator CPG.

The operation of the embodiment of circuit part III and circuit part IV as shown in FIG. 3*b* is as follows.

The control pulse generator CPG generates at its output terminal a periodical substantially square wave signal having the same frequency as the operating voltage. This substantially square wave signal renders the switching element S6 conductive and non-conductive. Thereby an operating voltage that is a substantially square wave modulated DC voltage is generated out of the DC voltage that is present on capacitor C1. This embodiment of circuit part III and circuit part IV is relatively simple and is very suitable to be used in combination with discharge lamps that can be operated by means of a DC discharge current. Apart from the operating voltage being a DC-voltage, the remaining part of the operation of the embodiments of circuit parts III and IV shown in FIG. 3*b* are similar to the embodiments shown in FIG. 3*a*.

We claim:

1. A circuit arrangement for, at a frequency f, alternately establishing and extinguishing a discharge in each of a plurality of discharge paths, each of the discharge paths is being associated with a respective first electrode situated at a first end of the respective discharge path and with a respective second electrode situated at a second end of the respective discharge path, comprising: means for generating operating voltages from a supply voltage, said operating voltages during operation being present across respective discharge paths and being periodical at the frequency f, wherein the same operating voltage is present across each discharge path, during operation each discharge path is associated with an auxiliary electrode situated alongside the discharge path, and switching means for connecting and disconnecting each of the auxiliary electrodes at the frequency f to a terminal of the circuit arrangement so as to establish an ignition voltage during a part of each period between one of the first and second electrodes and the auxiliary electrode associated with the same discharge path.

2. Circuit arrangement according to claim 1, wherein the terminal is at the same potential during operation as one of the electrodes of each discharge path.

3. Circuit arrangement according to claim 1, wherein the operating voltage is an alternating voltage.

4. Circuit arrangement according to claim 1, further comprising means for supplying a heating current to the electrodes.

5. Circuit arrangement according to claim 1 wherein the amplitude of the operating voltage is substantially square wave modulated.

6. Circuit arrangement according to claim 5 wherein the time intervals of the substantially square wave modulation are adjustable.

7. A lighting arrangement comprising:

at least first and second pairs of first and second electrodes spaced apart to define at least first and second discharge paths, at least first and second auxiliary electrodes located adjacent respective ones of said first and second discharge paths, means for supplying at a frequency f the same operating voltage to the first and second electrodes of said first and second pairs of electrodes, and switching means for connecting and disconnecting, at the frequency f, each of the auxiliary electrodes to a terminal of the lighting arrangement which will produce, during a respective part of each period of the frequency f, an ignition voltage between one of the first and second electrodes of each pair of first and second electrodes and the respective first and second auxiliary electrodes adjacent to the respective ones of said first and second discharge paths.

8. A lighting arrangement as claimed in claim 7, wherein said terminal comprises a corresponding one of said first and second electrodes of the first and second pairs of electrodes, and said switching means comprises first and second controlled switches coupled between said respective corresponding ones of said first and second electrodes and the associated respective first and second auxiliary electrodes.

9. A lighting arrangement as claimed in claim 8, further comprising a control circuit for alternately operating said first and second controlled switches during normal operation of the lighting arrangement and in a manner such that the first and second discharge paths are energized in different parts of each period of the frequency f.

10. Apparatus for alternately energizing at least first and second discharge paths at a frequency f, said first discharge path being defined by first and second spaced apart electrodes and said second discharge path being defined by third and fourth spaced apart electrodes, said apparatus comprising:

means for supplying, at the frequency f, the same operating voltage to the first and second electrodes and to the third and fourth electrodes, first and second auxiliary electrodes located in the vicinity of the first and second discharge paths, respectively, switching means for alternately coupling, at the frequency f, the first and second auxiliary electrodes to a terminal of the apparatus at which a voltage is present such as to produce, for a respective discharge path, an ignition voltage between one of the first and second electrodes and the first auxiliary electrode and one of the third and fourth electrodes and the second auxiliary electrode, and a control circuit for operating said switching means so that, during normal operation of the apparatus, the first and second discharge paths are each energized for a part of each period (1/f).

11. The apparatus as claimed in claim 10 wherein, during normal operation of the apparatus, the terminal is at the same potential as one of the electrodes defining each of the first and second discharge paths.

12. The apparatus as claimed in claim 10, wherein said first, second, third and fourth electrodes couple the first and second discharge paths in parallel to said means for supplying an operating voltage.

13. The apparatus as claimed in claim 10, wherein said operating voltage is an alternating voltage.

14. The apparatus as claimed in claim 13, further comprising means for square wave amplitude modulating the operating voltage.

15. The apparatus as claimed in claim 14, further comprising means for adjusting the time intervals of the square wave modulation of the operating voltage.

16. The apparatus as claimed in claim 10, wherein said first and second electrodes are situated within an envelope of a first discharge lamp and the third and fourth electrodes are situated within an envelope of a second discharge lamp, and means for supplying a heating current to the electrodes of the first and second discharge lamps.

17. The apparatus as claimed in claim 10, wherein said control circuit operates said switching means so that the first and second discharge paths are alternately energized during mutually exclusive time intervals.

18. The apparatus as claimed in claim 10 further comprising:

fifth and sixth spaced apart electrodes defining a third discharge path and a third auxiliary electrode located in the vicinity of the third discharge path, wherein the same operating voltage is supplied to the fifth and sixth electrodes as to the first and second and third and fourth electrodes, the switching means alternately couples, at the frequency f, the third auxiliary electrode to the terminal at which an ignition voltage is present, and the control circuit operates said switching means so that, during normal operation of the apparatus, the third discharge path is energized for a further part of each period (1/f).

19. The apparatus as claimed in claim 18, wherein said first and second electrodes, said third and fourth electrodes, and said fifth and sixth electrodes, are situated within first, second and third envelopes, respectively, of first, second and third discharge lamps, each of said discharge lamps having a luminescent layer that emits light of a different color.

20. The apparatus as claimed in claim 10, further comprising means for square wave amplitude modulating the operating voltage so as to establish first, second, third and fourth time intervals in each period wherein the operating voltage is zero during the first and third time intervals and is a high frequency AC voltage during the second and fourth time intervals, the switching means comprised first and second switching devices coupling the first and second auxiliary electrodes, respectively, to one terminal of the means for supplying an operating voltage, and the control circuit closes the first and second switching devices during the first and third time intervals, respectively, whereby during the second and fourth time intervals the high frequency AC operating voltage is present between the first and second auxiliary electrodes, respectively, and one of the first and second electrodes and one of the third and fourth electrodes, respectively, so that a discharge is established in the first and second discharge paths during the second and fourth time intervals, respectively.

* * * * *